United States Patent [19]

McMahon

[11] 4,258,871

[45] Mar. 31, 1981

[54] UNIVERSAL HOLSTER ASSEMBLY

[76] Inventor: Robert J. McMahon, 3400 Pickertown Rd., Warrington, Pa. 18976

[21] Appl. No.: 136,551

[22] Filed: Apr. 2, 1980

[51] Int. Cl.[3] ..... F41C 33/02; F41B 13/04

[52] U.S. Cl. ..... 224/192; 224/206; 224/243; 224/911

[58] Field of Search ..... 224/192, 193, 198, 204, 224/205, 206, 208, 222, 911

[56] References Cited

U.S. PATENT DOCUMENTS

| | | | |
|---|---|---|---|
| 837,156 | 11/1906 | Townsend | 224/2 B |
| 1,876,613 | 9/1932 | Clark | 224/2 |
| 2,037,132 | 4/1936 | Hoyt | 224/193 X |
| 2,579,782 | 12/1951 | Booth | 224/911 X |
| 2,609,979 | 9/1952 | Spann | 224/2 |
| 2,819,830 | 1/1958 | Murray | 224/2 |
| 2,951,622 | 9/1960 | Heim | 224/2 |
| 3,003,670 | 10/1961 | Stella | 224/2 |
| 3,227,336 | 1/1966 | Dickey | 224/2 |
| 3,252,638 | 5/1966 | Rolston et al. | 224/2 |
| 3,583,611 | 6/1971 | Theodore | 224/2 |
| 3,942,692 | 3/1976 | Chica | 224/911 X |
| 4,022,361 | 5/1977 | Devlin | 224/2 B |
| 4,029,242 | 6/1977 | Stoesser | 224/222 |
| 4,084,734 | 4/1978 | Bianchi et al. | 224/2 B |

FOREIGN PATENT DOCUMENTS 2639248 3/1978 Fed. Rep. of Germany .

OTHER PUBLICATIONS

Velcro Attachment Manual for Sewing, 9/72.

*Primary Examiner*—Steven M. Pollard

*Attorney, Agent, or Firm*—Z. T. Wobensmith, 2nd; Z. T. Wobensmith, III

[57] ABSTRACT

A holster assembly for handguns and the like is disclosed, having a wide range of uses, adapted to be supported under the arm in the armpit on either side thereof attached to a shoulder harness or attached to either leg.

10 Claims, 12 Drawing Figures

UNIVERSAL HOLSTER ASSEMBLY

CROSS REFERENCE TO RELATED APPLICATIONS

This application is refiled to take the place of prior abandoned application Ser. No. 903,698, filed May 5, 1978, for Universal Holster Assembly.

BACKGROUND OF THE INVENTION

1. Field of the Invention

This invention relates to a holster assembly for handguns of the type which can be used at any desired location adjacent either armpit or on either leg.

2. Description of the Prior Art

Peace officers and other who carry handguns are faced with a dilemma in that the available holsters are designed for use either inside or outside the wearer's trousers, or for either but not both right or left hand wear as shoulder holsters. It is necessary that the wearer must buy a variety of holsters to fit different conditions such as when the wearer is on duty, off duty, or is working undercover.

The wearer is therefore forced to purchase a separate holster to be worn on the shoulder under the arm and additional holsters if the wearer desires to change from a right hand to a left hand draw.

There have been a variety of holsters provided in the prior art some of which have been presented as being universal but none of them provides the versatility of my holster.

The U.S. Pat. to Murray, No. 2,819,830, discloses a holster which is illustrated in a variety of locations on a wearer including on the belt outside the trousers, attached to a band around the leg of the wearer, and under the armpit of the wearer for a cross draw. The holster is not adapted to be worn inside a coat or jacket or inside a trouser leg or to be used by both right and left handed wearers.

The U.S. Pat. to Heim, No. 2,951,622, illustrates a holster which can be used for both right and left hand use and includes an embodiment for use under the arm adjacent the shoulder of the wearer. This holster, however, is limited as to the locations where it can be worn, and cannot be worn inside a trouser leg.

The U.S. Pat. to Stella, No. 3,003,670, illustrates a right and left hand holster which can only be worn on the belt of the wearer outside the trousers, and is not suitable for use as a shoulder holster nor for carrying a weapon inside a trouser leg.

The U.S. Pat. to Dickey, No. 3,227,336, illustrates a handgun holster which includes a clip to enable it to snap over a belt and be worn inside a clip to enable it to snap over a belt and be worn inside the trousers of the wearer. This holster is not satisfactory for wear on the lower leg inside the trousers of the wearer since it would not be securely retained nor would it be useful as a shoulder holster.

The U.S. Pat. to D.S. Rolston et al., No. 3,252,638, illustrates a reversible left and right hand holster which is adapted to be worn outside the trousers of the wearer secured to his belt but is not adapted to be worn on a lower leg inside the trousers or on the shoulder of the wearer.

The U.S. Pat. to Devlin, No. 4,022,361, shows a holster case 12, employing Velcro at 23 around the lower portion of the holster case 12 and a sling 14 having an elongate strap 16 extending upwardly beyond the upper edge of the case 12 with a transverse holster attaching strip 18 for engagement with the Velcro at 23. The upper end of the sling 16 has a fastener tab 30 for securing to the belt of the user which has Velcro at 55 for this purpose. Alternative modes of attachment of the holster to the belt are shown in FIGS. 7 and 8. The structure of Devlin is not suited for use with a shoulder harness nor for attachment to the lower leg of the user inside a trouser leg.

The U.S. Pat. to Clark, No. 1,876,613, shows a holster which has a portion engageable with a belt B and a loop which engages the belt B. Internally disposed spring clips are provided to retain the holster along the forward edge but permit drawing the gun through the front. There is no structure disclosed relating to a shoulder harness nor for attachment to the lower leg of the user inside a trouser leg.

The U.S. Pat. to Townsend, No. 837,156, shows a belt carried holster which has no teaching of a shoulder holster nor of a lower leg carried holster.

The U.S. Pat. to Spann, No. 2,609,979, shows a pistol holster which requires buttons from the wearer's trousers for engagement in slits in flaps extending from the holster which is retained at the uppermost portion by a suspender strap 13, which engages in a slot in the holster. The Spann structure does not show a holster nor a holster carried or capable of being carried on a lower leg of the user.

The U.S. Pat. to Bianchi et al., No. 4,084,734, shows a combined shoulder and belt holster, in which the holster 10 has belt loop slots 24 and 25 on one side and belt loop slots 64 and 65 on the other side for mounting either side on a belt 60 for right or left hand draw. The holster 10 is also adapted to be worn as a shoulder holster as illustrated in FIGS. 1 and 2 and in which a screw 40 (see FIG. 4) which biases the outer faces of the holster together, the screw 40 providing a fulcrum for the barrel when the weapon is drawn. A shoulder strap 50 extends over the shoulder of the user with its ends permanently secured by rivets or adjustable by snap or other fasteners to the rings 21 and 30 to support the holster 10 in the armpit region. The support of the holster 10 in the Bianchi et al. patent is accomplished in a very different manner than that of the present invention.

The U.S. Pat. to Theodore, No. 3,583,611, shows a belt holster which is in the form of a strap which wraps over the top of the frame of a hand gun and is secured to the trigger guard by a releasable fastening device to hold the weapon. The belt holster may also be used under the armpit by a shoulder holster as shown in FIGS. 2, 7 and 8 shown for right hand draw. The support of the holster in Theodore bears very little resemblance to that of the present invention.

the German Pat. No. 2,639,248 to Stammel shows a holster for firearms which can be carried on the right or the left on the belt or under the armpits. The holster comprises a holster A, a holster enclosing body B and a holster holding web c, connected by press studs, loops and slot guides. The shoulder supports are shown at 30, 31, 35, 36 and 37 but the supports for the holster as disclosed in the present application are not shown.

The publication Velcro-Attachment Manual for Sewing shows various uses for Velcro Hook and Loop Tapes, also known as thistle cloth, but not the structure as disclosed in the present application.

Summarizing briefly, none of the prior art shows a holster having an interior pocket for selective disposition for right or left hand draw with a plurality of panels of thistle cloth, a support member in engagement with snap means and with thistle cloth with the holster and straps extending therefrom for support on the lower leg or under the arm.

SUMMARY OF THE INVENTION

In accordance with the invention a universal holster assembly is provided suitable for both right and left handed users which can be worn under either of the wearer's armpits or mounted on either lower leg inside the trousers.

The principal object of the invention is to provide a universal holster assembly that can be quickly and easily located and relocated on a wearer in any one of a selected plurality of locations without alterations to the holster.

A further object of the invention is to provide a universal holster assembly which can be used by both right and left handed users.

A further object of the invention is to provide a universal holster assembly which provides for secure retention of a handgun regardless of the location where the holster is worn.

a further object of the invention is to provide a universal holster assembly that is relatively inexpensive to construct but which will provide long service.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
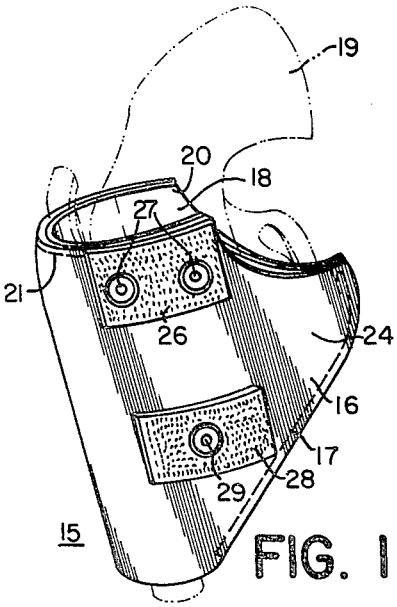
FIG. 1 is a perspective view of one embodiment of the holster of my invention as seen from one side with a handgun shown in phantom therein.
Figure 2:
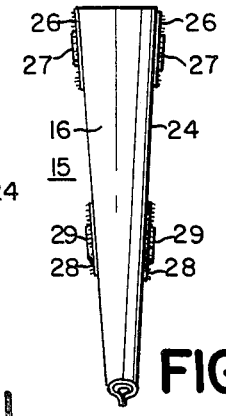
FIG. 2 is an end elevational view of the holster assembly shown in FIG. 1.
Figure 3:
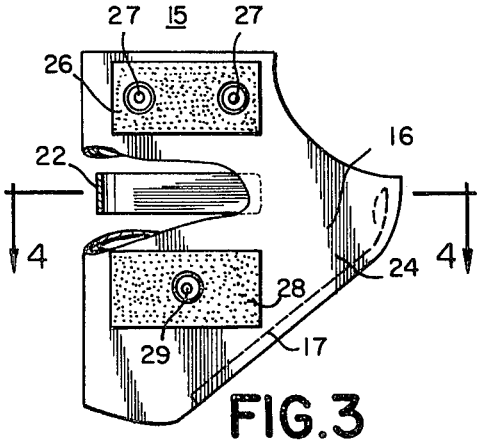
FIG. 3 is a side elevational view of the holster assembly of my invention with a portion broken away to show the internal construction.
Figure 4:
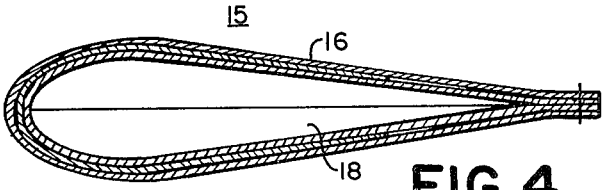
FIG. 4 is a horizontal sectional view taken approximately on the line 4—4 of FIG. 3.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings, the holster body 15 is preferably made from a single piece of leather to form an outer layer 16 which is cut to form the general outline of a holster of well known shape with the outer layer 16 joined together along one edge by a line of stitching 17, and with an interior pocket 18. The holster body 15 can be of any desired size to carry the desired size of handgun 19. The handgun 19 illustrated has a small frame such as a 2½ inch barrel model 60 revolver available from Smith and Wesson, Springfield, Massachusetts.

The outer layer 16 has an inner layer 20 of the same shape joined together by a line of stitching 21 and the line of stitching 17 to form the pocket 18 to receive the handgun. A U-shaped spring metal clip 22 is preferably provided located and retained between the inner and outer layers 20 and 16 to compress the layers 16 and 20 together to grip and detachably retain the handgun 19 therein.

On each side of the holster body 15 the side faces 24 and 25 thereof are each provided with upper panels 26 which are formed of a strip of thistle cloth such as that sold under the trademark "VELCRO" which includes a strip of pile material and a strip of hook like material which may be easily engaged and disengaged many times without any appreciable wear, the thistle cloth strips of the panels 26 preferably being of pile material.

The upper panels 26 are secured to the side faces 24 and 25 in any suitable manner such as by an adhesive (not shown) and as illustrated have the female snap portions 27 of a pair of snaps engaged therewith which also extend through the outer layer 16.

The holster body 15 also has a pair of lower panels 28 affixed to the side faces 24 and 25 such as by an adhesive of well known type (not shown) and are preferably of the pile material portion of thistle cloth. The female snap portion 29 of a single snap is engaged with each of panels 28 and extends through the outer layer 16.

Figure 5:
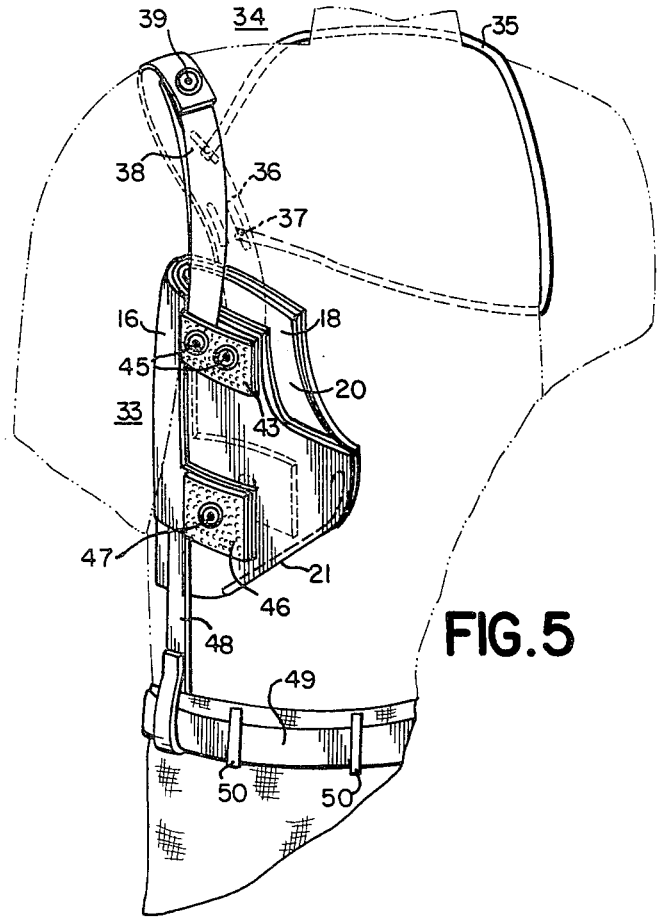
FIG. 5 is a fragmentary perspective view of one preferred embodiment of the holster assembly of my invention for use with a shoulder harness for left hand draw.
Figure 6:
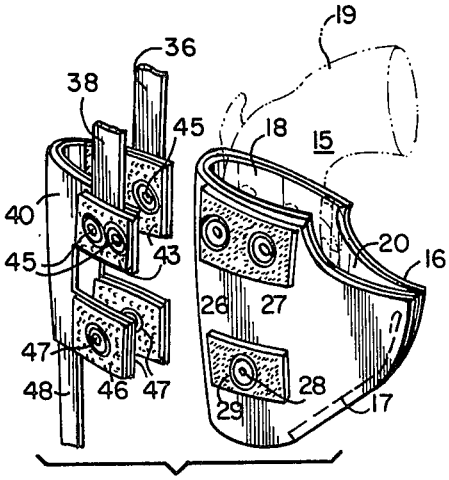
FIG. 6 is a partial exploded perspective view of the holster assembly of FIG. 5, showing one form of supporting structure.
Figure 7:
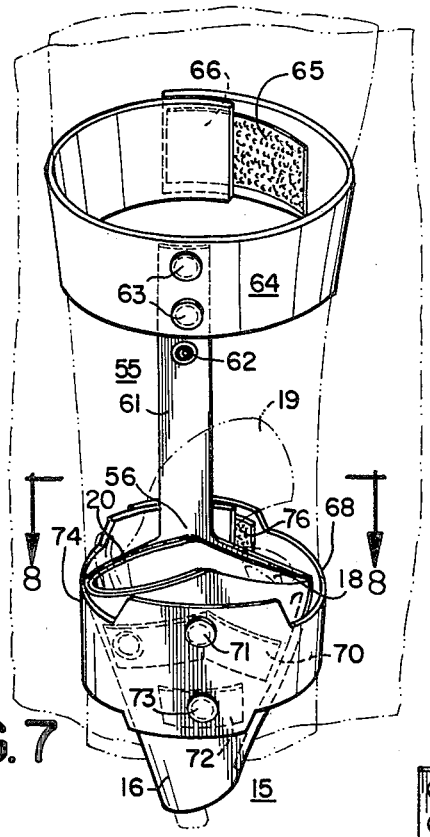
FIG. 7 is a view in perspective of a holster interiorly supported on the inside of the right leg of a user.
Figure 9:
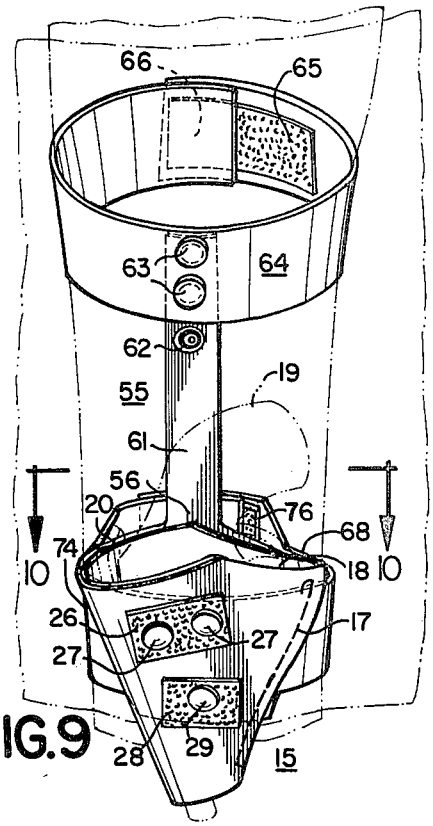
FIG. 9 is a view in perspective of a holster exteriorly supported on the inside of the left leg of the user.
Figure 11:
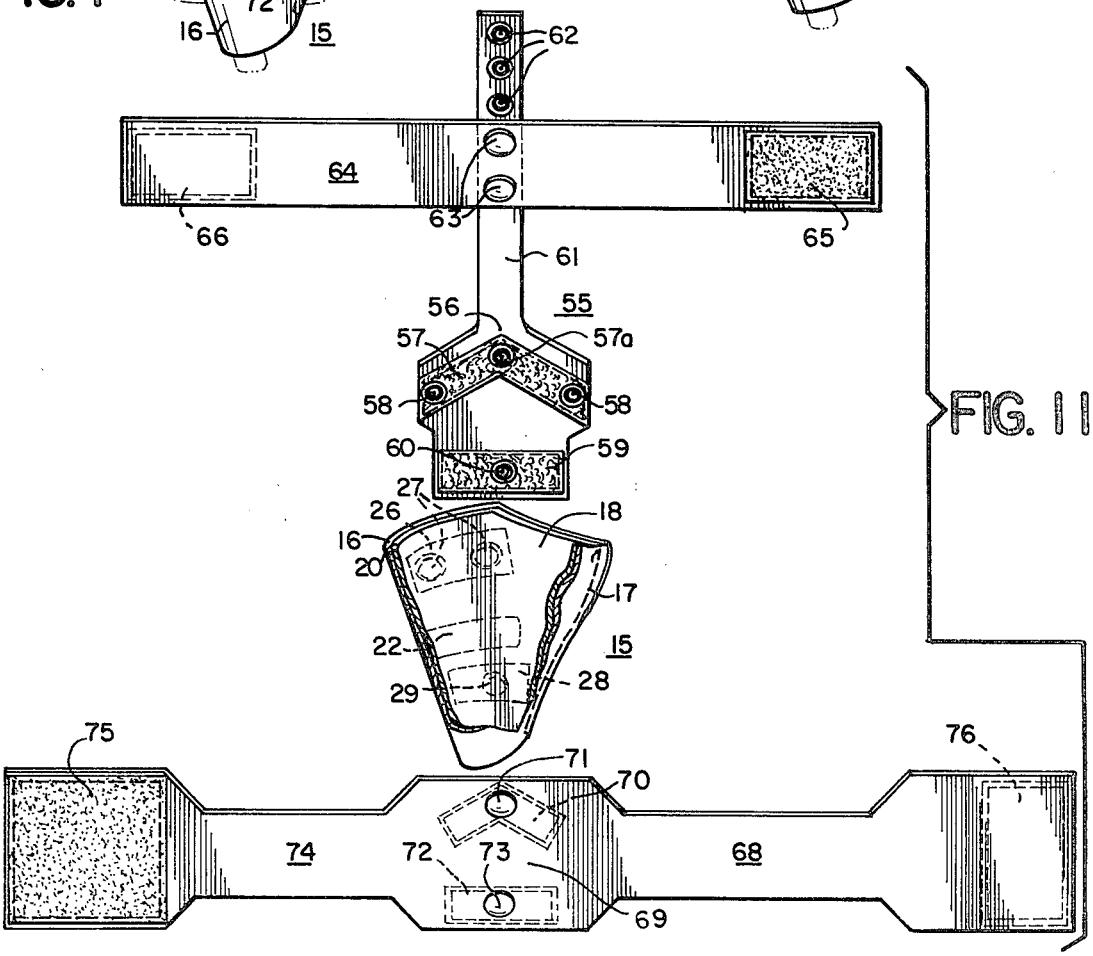
FIG. 11 is an exploded view of the holster and its supporting structure, taken from FIG. 9 and as seen from the inside.
Figure 12:
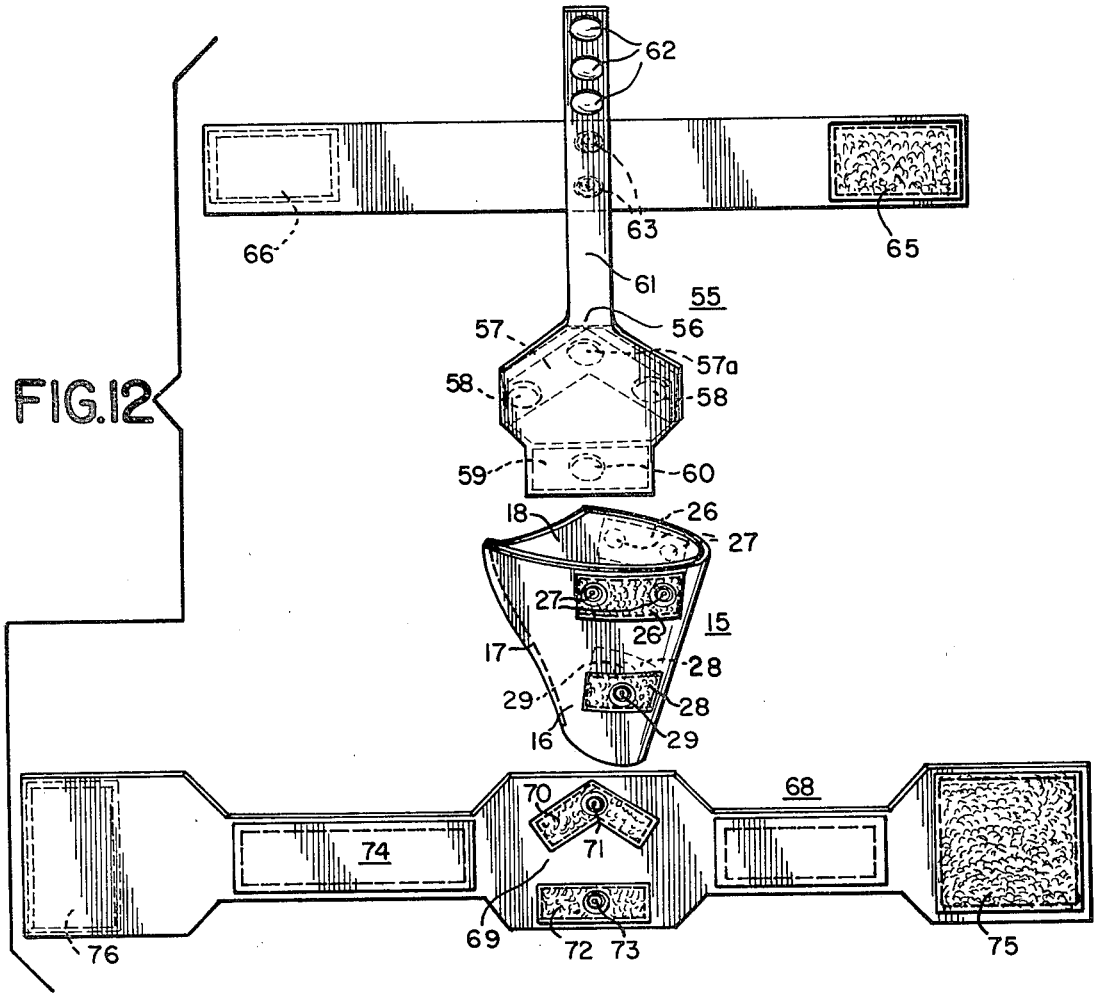
FIG. 12 is a view similar to FIG. 11 as seen from the outside.
Figure 8:
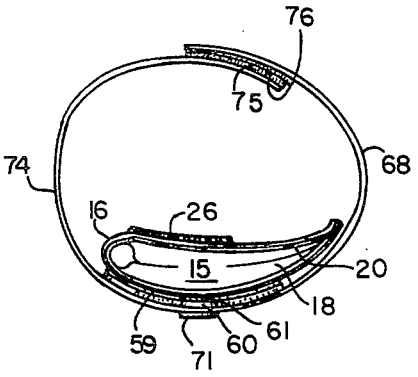
FIG. 8 is a horizontal sectional view taken approximately on the line 8—8 of FIG. 7.
Figure 10:
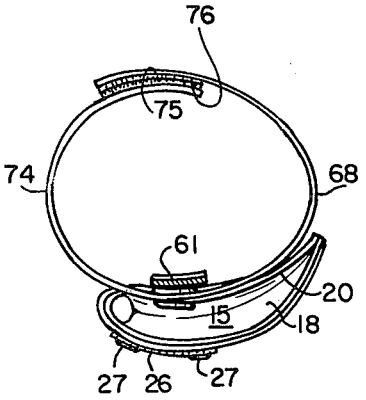
FIG. 10 is a horizontal sectional view taken approximately on the line 10—10 of FIG. 9.

As shown in FIGS. 5 and 6, a holster body 33 for the holster body 15 is provided, for use as a shoulder holster, and includes a harness 34 of well known type with a strap 35 extending around the neck and back of a wearer shown in phantom, and has a strap 36 detachably fastened thereto by pins 37 which extend behind the shoulder of the wearer, the strap 36 being connected to the holster body support 33. Another strap 38 is detachably engaged with the strap 36 by snaps 39 the strap 36 extending over the top of the shoulder of the wearer and being fixedly connected to the holster body support 33.

The holster body positioner and support 33 is of U-shape in horizontal cross section with an upper portion 40 on each face 41 and 42 with panels 43 on each side of hook like material complementary to the pile material on the upper panels 26 of the holster body 15 and with male snap portions 45 detachably engageable with the female snap portions 27 of the panels 26 of the holster body 15.

The holster positioner and support member 33 also has a lower portion 45 on each face 41 and 42 with lower panels 46 on each side of hook like material complementary to the pile material on lower panels 43 of the holster body 15 and with male snap portions 47 detachably engageable with the female snap portions 29 on the lower panels 28.

A downwardly extending strap 48 is provided and is connected to the holster support 33 and preferably extends to a belt 49 worn about the waist of the wearer and passing through belt loops 50 to restrain the holster support 33 from upward movement.

The holster positioner and support 33 and the holster body 15 and the harness 34 can be worn on the right or left shoulder by using the upper panels 43 in engagement on each side with the upper panels 26 and with the snap portions 45 and 27 in engagement and the lower panels 46 in engagement, and with the lower panels 46 in engagement on each side with the lower panels 28, and with the snaps 47 and 29 in engagement on each side, to position the holster body 15 at the desired armpit.

Referring now to FIGS. 7 to 11, inclusive, the holster body 15 is there shown as mounted to the inside of the lower left leg or right leg, as desired, for concealment by the trouser leg.

The holster body 15 is the same as that previously described and the holster positioner and support 55 for this purpose is modified from that previously described. The holster positioner and support 55 has an upper portion 56 with a thistle cloth panel 57 of hook type, preferaby of inverted U-shape, for engagement with the upper panel 26, with an upper central male snap 57*a* and two lower male snaps 58 for engagement with the pair of snaps 27 of the holster body 15 to permit of tilting the holster body 15 toward the rear of the lower leg on either side to aid in concealment of the holster body 15 and the handgun 19 mounted therein. The holster support 55 also has a lower thistle cloth panel 59 of hook type for engagement with the lower panel 28, and with a male snap 60 therein for engagement with the snap 29.

The holster positioner and support 55 has a strap 61 extending upwardly therefrom with a plurality of male snaps 62 for engagement with female snaps 63 carried on a horizontally disposed supporting strap 64 having end panels 65 and 66 of complemental thistle cloth, for adjustment of the strap 64 in accordance with the circumference of the lower leg of the user above the holster body 15 in engagement with the inwardly disposed side face 24 or 25 of the holster body 15.

An additional holster positioner or support 68 is provided having a mounting portion 69 with an upper inverted V-shaped panel 70 of thistle cloth of the hook type for engagement with the outer of the upper panels 26. Male snaps 71 are provided for engagement with the female snaps 27. A lower thistle cloth panel 72 having a male snap 73 at the center thereof is also provided for engagement of the mounting portion 69 so that the lower panel 72 is engaged with the lower panel 28 and the snap 73 is engaged with the snap 29. The portion 69 has a horizontally disposed strap 74 connected thereto with end panels 75 and 76 of complemental thistle cloth for adjustment of the strap 74 in accordance with the circumference of the lower leg of the user at the place of application of the strap 74.

It will be noted that with the construction of FIGS. 7 to 11, the handgun 19 can be mounted on either lower leg for right or left hand use, as desired, and that the handgun 19 can be mounted in a tilted position for ease of access and better concealment.

I claim:

1. A universal holster assembly for hand guns which comprises a holster body having an interior pocket to carry a hand gun and having opposite outer side faces and upper marginal edges, upper and lower exposed panel portions on each of said opposite outer side faces of said holster body, each of said panel portions being of thistle cloth material for selective right and left hand disposition of said holster body, a plurality of upper snap members associated with said upper panel portion, a lower snap member associated with said lower panel portion, and supporting means for said holster body comprising a holster positioner and support means for retention on at least one of said opposite outer side faces of said holster body, said holster positioner and support means having upper and lower exposed panel portions of complemental thistle cloth for engagement with upper and lower panel portions on said side face of said holster body, a plurality of upper snap members associated with said upper panel of said holster positioner and support means for engagement with said upper snap members of said holster body, and a lower snap member associated with said lower panel of said holster positioner and support means for engagement with said lower snap member of said holster body, said holster positioner and support means having a vertically disposed positioning strap extending therefrom.

2. A universal holster assembly as defined in claim 1 in which said holster positioner and support means has spaced panels and snap members for engagement with panels and snap members on both side faces of said holster body.

3. A universal holster as defined in claim 2 in which said positioner and support means is U-shaped in horizontal cross section.

4. A universal holster as defined in claim 2 in which said positioner and support means has an additional vertically disposed positioning strap extending therefrom.

5. A universal holster as defined in claim 4 in which a body harness is provided to which said positioning straps are connected.

6. A universal holster as defined in claim 2 in which said positioner and support means has a vertically downwardly extending positioning strap connected thereto.

7. A universal holster as defined in claim 1 in which said holster positioner and support means comprises a first portion having upper and lower panel portions in engagement with the upper and lower panels on said holster body on one side face thereof, and a second portion having upper and lower panel portions in engagement with the upper and lower panels on said holster body on the other side face thereof.

8. A universal holster as defined in claim 7 in which said first portion has said vertically disposed positioning strap extending upwardly, a horizontally disposed strap is provided extending around a lower leg of the user and is adjustable in length for engagement around the leg, and said upwardly extending strap is adjustably secured to said horizontally disposed strap.

9. A universal holster as defined in claim 7 in which a horizontally disposed strap is connected to said second portion and extends around a lower leg of the user and is adjustable in length for engagement around said lower leg.

10. A universal holster as defined in claim 7 in which said first portion has said vertically disposed positioning strap extending upwardly, a horizontally disposed strap is provided extending around a lower leg of the user and is adjustable in length for engagement around the leg, said upwardly extending strap is adjustably secured to said horizontally disposed strap, and a horizontally disposed strap is connected to said second portion and extends around a lower leg of the user and is adjustable in length for engagement around said lower leg.

* * * * *

UNITED STATES PATENT AND TRADEMARK OFFICE

CERTIFICATE OF CORRECTION

PATENT NO. : 4,258,871

DATED : March 31, 1981

INVENTOR(S) : Robert J. McMahon

It is certified that error appears in the above—identified patent and that said Letters Patent is hereby corrected as shown below:

Column 1,

Line 54, after "worn" delete - inside a clip to enable it to snap over a belt and be worn -

Column 2,

Line 27, after "a" insert - shoulder -

Signed and Sealed this

*Twenty-fourth* Day of *August 1982*

[SEAL]

*Attest:*

GERALD J. MOSSINGHOFF

*Attesting Officer*

*Commissioner of Patents and Trademarks*